US006056045A

United States Patent [19]

Matsuzaki et al.

[11] Patent Number: 6,056,045

[45] Date of Patent: May 2, 2000

[54] VEHICLE ENGINE COOLING RADIATOR

[75] Inventors: Yoshitomi Matsuzaki; Seiji Kawachiya, both of Kanagawa-ken, Japan

[73] Assignee: Nissan Motor Co., Ltd., Kanagawa-ken, Japan

[21] Appl. No.: 08/967,613

[22] Filed: Nov. 10, 1997

[30] Foreign Application Priority Data

Nov. 15, 1996 [JP] Japan ..... 8-305087

[51] Int. Cl.[7] ..... F28F 7/00

[52] U.S. Cl. ..... 165/134.1; 165/70

[58] Field of Search ..... 165/70, 134.1

[56] References Cited

U.S. PATENT DOCUMENTS 1,800,842 4/1931 Modine ..... 165/70

1,865,536 7/1932 Modine ..... 165/70

FOREIGN PATENT DOCUMENTS 4-138580 12/1992 Japan .

*Primary Examiner*—Leonard Leo

*Attorney, Agent, or Firm*—McDermott, Will & Emery

[57] ABSTRACT

A rib is provided around a hose connecting portion which is projected from an upper tank of a radiator. A cooling water which is leaked from a fitting portion between a hose and a hose connecting portion is guided to a predetermined position by the rib. As a result, such an event can be eliminated that the leakage cooling water drops downward and then attaches to a caulking portion between the upper tank and a core portion and thus such water is misconceived for a leakage water generated from the caulking portion.

9 Claims, 6 Drawing Sheets

VEHICLE ENGINE COOLING RADIATOR

The contents of Application No.TOKUGANHEI 8-305087, filed on Nov. 15, 1996 in Japan is hereby incorporated by reference.

BACKGROUND OF THE INVENTION

The present invention relates to a vehicle engine cooling radiator (referred simply to as a "radiator" hereinafter) and, more particularly, a structure concerning radiator hose (referred simply to as a "hose" hereinafter) connecting portions provided on an upper tank and a lower tank of the radiator.

In general, the radiator is formed by caulking the upper tank and the lower tank on and under a core portion so as to have an integral airtight and watertight structure (see Utility Model Application (KOKAI) 4-138580, for example). Cylindrical hose connecting portions are provided to the upper tank and the lower tank respectively. One ends of the hoses are connected to the hose connecting portions respectively. The other ends of the hoses are connected to an engine or a thermostat to form a circulation path of an engine cooling water.

Hot water which is passed through a cooling water path (water jacket) in the engine by a water pump is supplied to the upper tank via the hose. The hot water supplied to the upper tank is cooled by wind caused by running of the vehicle or wind supplied by a radiator fan when it is passed through the core portion consisting of a number of fine water paths and radiation fins, then is supplied to the lower tank, and then is circulated to the thermostat via the hose.

The hoses are inserted into the cylindrical hose connecting portions, and then clamped to the hose connecting portions by hose clamps. Thus, airtightness and watertightness of the connecting portions can be increased and also disconnection of the hoses can be prevented. Near a top end portion of the hose connecting portion, a convex rim is formed around a whole periphery of the hose connecting portion. Airtightness and watertightness and a hose disconnection preventing effect of the radiator can be enhanced by clamping inner and outer peripheral surfaces of the hose with the convex rim and the hose clamp respectively.

Incidentally, the hose connecting portion of the lower tank and the hose are formed to have similar structures to those of the upper tank.

SUMMARY OF THE INVENTION

However, in the above radiator, sometimes airtightness and watertightness of connection portions between the hose connecting portions and the hoses are degraded because of heat load such as overheat, aged deterioration of the hose, etc., to generate leakage of the cooling water.

If such leakage water is generated, the leaked cooling water drops along the wall surface of the upper tank and then stays on caulking portions of the upper tank and the core portion. Sometimes, such cooling water staying on the caulking portions is misconceived for the leakage water leaked from the caulking portions. Consequently, only the repair of the hose exchange should be essentially carried out, nevertheless the extensive repair of the radiator unit exchange may be carried out. Therefore, it is requested that increase in the repairing charges because of such misconception should be prevented.

In addition, the hose clamp is mounted on the convex rim of the hose connecting portion to thus cause clamping displacement when it is not clamped to its proper fitting position. In this case, the hose clamp cannot sufficiently execute a function as leakage preventing means or disconnection preventing means, so that in some cases the leakage water is generated from the connection portions between the hoses and the hose connecting portions.

As one factor to cause the above clamping displacement, in the situation that the hose is fitted to the hose connecting portion, it can be considered that a convex position of the convex rim of the hose connecting portion is difficult to be observed with the eye from the outside of the hose because of a thickness of the hose. Therefore, in order to prevent the leakage water caused by such clamping displacement, it is requested to ensure more accurate positioning of the hose clamp without dependence on visual observation or perception when the hose clamp is fitted on the hose.

It is an object of the present invention to provide a vehicle engine cooling radiator capable of preventing leakage water due to displacement of the hose clamp fitting position and also clearly discriminating water leakage locations once leakage water occurs at connection portions between hose fitting portions and radiator hoses.

In order to achieve the above object, a vehicle engine cooling radiator according to the present invention comprises, a radiator main body for radiating an engine cooling water supplied from an inlet portion and discharging the engine cooling water from an outlet portion; a connection tube formed to protrude from at least one of the inlet portion and the outlet portion, the connection tube connected with a hose which carries the engine cooling water; and a guiding member arranged below the connection tube to guide a liquid leaked from a connection portion between the connection tube and the hose to an appropriate position.

The appropriate position to which the guiding member guides the liquid signifies a location in which the liquid is not misconceived for another liquid flown out from positions other than the connection portion between the connection tube and the hose. For example, the appropriate position is a position kept separate from the radiator main body.

The guiding member may be formed to surround at least lower side and lateral sides of the connection tube.

A clearance having a width larger than a thickness of the hose may be formed between the guiding member and the connection tube, the hose may be inserted into the clearance to be fitted on an outer surface of the connection tube, and the guiding member may have an opening through which a top end of the hose connected to the connection tube is visually observed.

The opening may be formed on an upper side of the guiding member.

The opening may be formed as a notch.

The hose may be fitted on an outer surface of the connection tube and clamped on the connection tube by a claming member mounted on the hose, the guiding member may be formed to come into contact with the clamping member mounted on the hose so that the guiding member prevents the clamping member from entering into an inside of the guiding member, and the connection tube may have a top end portion projected more than the clamping member mounted on the hose and being in contact with said guiding member.

An inner diameter of the guiding member may be formed to be smaller than an outer diameter of the clamping member.

The connection tube may have an annular convex rib to restrain a disconnection of the hose from the connection tube, and the convex rib may be arranged on the top end portion of the connection tube.

According to the vehicle engine cooling radiator of the present invention, the guiding member is provided lower than the connection tube, so that the liquid leaked from the connection portion between the connection tube and the hose can be guided to the appropriate position where no trouble is caused by drop of the liquid. Accordingly, the liquid leaked from the connection portion between the connection tube and the hose does not drop along a wall surface of the radiator main body and does not stay thereon. Therefore, such an event can be eliminated that the liquid leaked from the connection portion is misconceived for a leakage water leaked from the radiator main body. Hence, repaired portions can be easily specified and therefore unnecessary repairs can be eliminated.

In addition, if the opening is provided on the guiding member, it can be confirmed by visual observation whether or not the hose has been correctly inserted.

Further, if a projecting length of the connection tube and the guiding member is appropriately decided such that the top end portion of the connection tube protrudes longer than the clamping member, which is mounted on the connection tube and is in contact with the guiding member, the hose clamp can always be properly positioned only by abutting the clamp member to an end surface of the guiding member. As a result, the liquid from the connection portion caused by an error in the hose clamp fitting position can be prevented.

DESCRIPTION OF THE PREFERRED EMBODIMENTS

Embodiments of the present invention will be explained with reference to accompanying-drawings hereinafter.

First Embodiment

Figure 1:
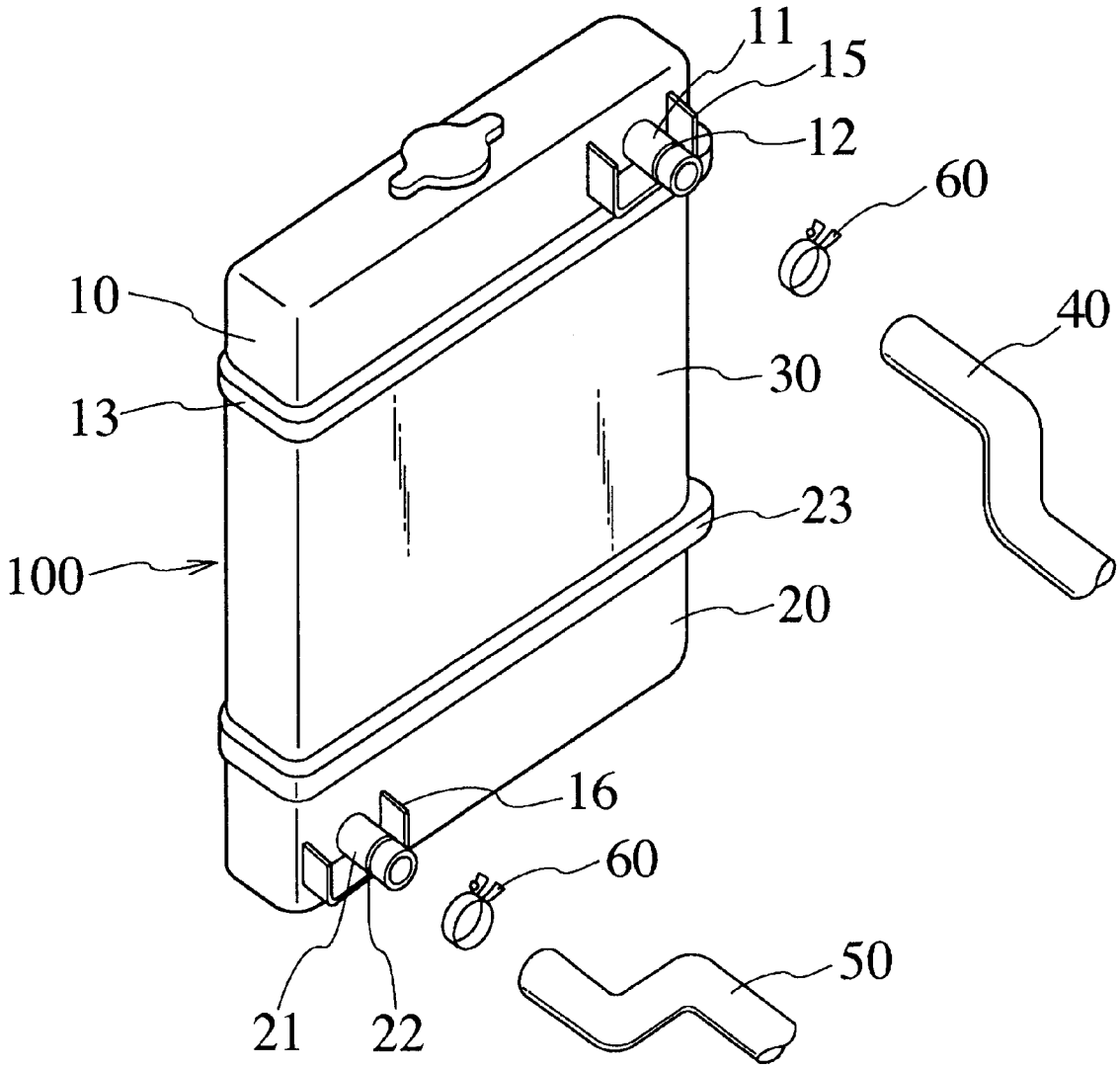
FIG. 1 is a perspective view showing a configuration of a radiator according to a first embodiment of the present invention.
Figure 2:
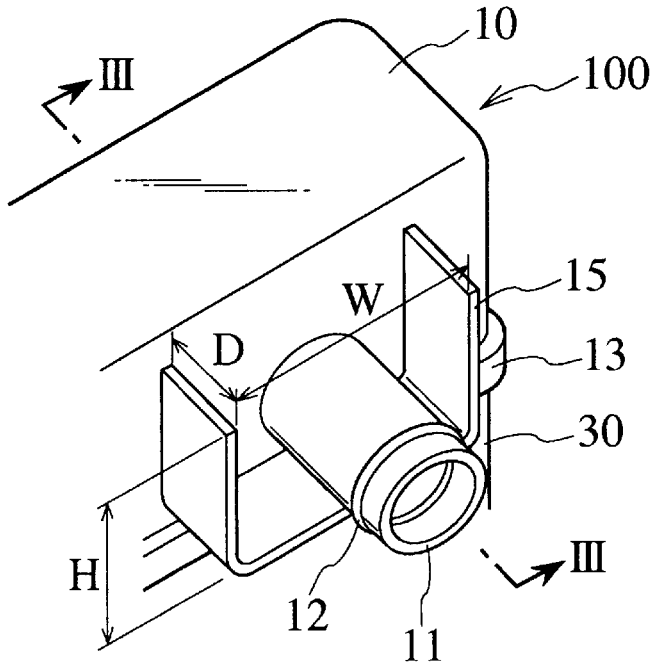
FIG. 2 is a perspective view showing a hose connecting portion of an upper tank of a radiator according to the first embodiment of the present invention.
Figure 3:
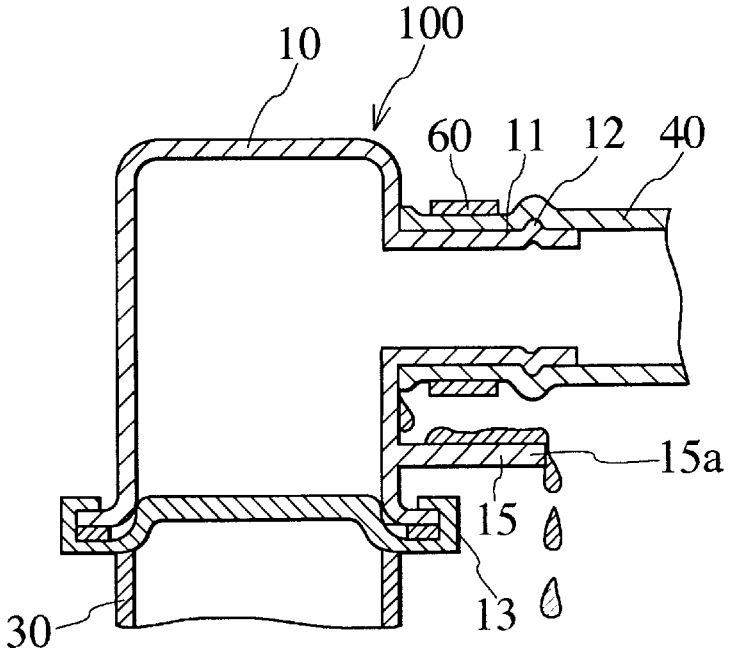
FIG. 3 is a sectional view showing a vertical sectional shape taken along a line III—III in FIG. 2 to illustrate a condition wherein a hose and a hose clamp are installed.
Figure 4:
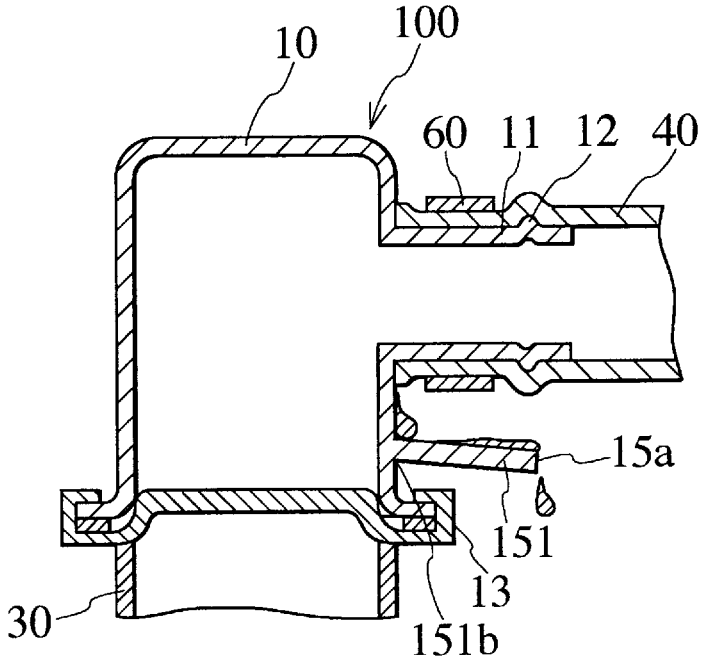
FIG. 4 is a vertical sectional view showing a hose connecting portion in an upper tank of the radiator according to a modification of the first embodiment of the present invention.
Figure 5:
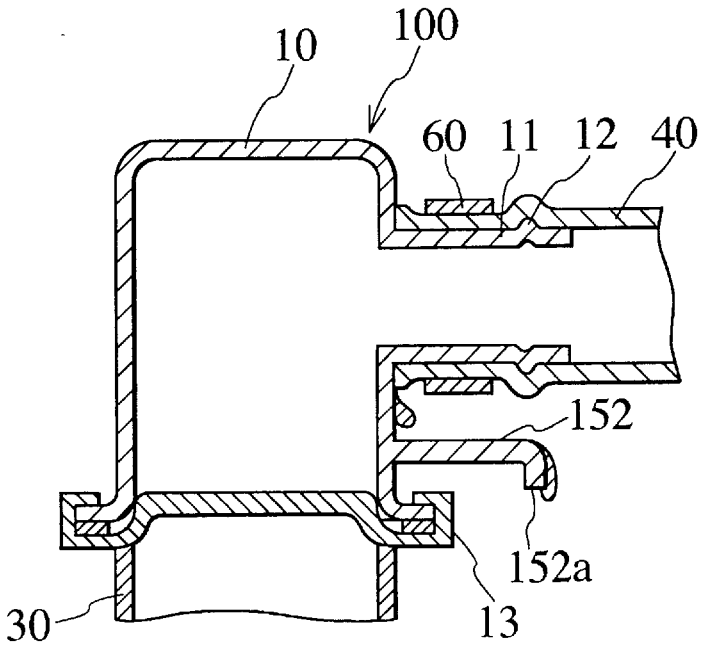
FIG. 5 is a vertical sectional view showing a hose connecting portion in the upper tank of the radiator according to another modification of the first embodiment of the present invention.

A first embodiment of the present invention will be explained with reference to FIGS. 1 to 5 hereunder. FIG. 1 is a perspective view showing a configuration of a radiator according to the first embodiment of the present invention. FIG. 2 is a perspective view showing a pertinent portion around a hose connecting portion of an upper tank of a radiator in FIG. 1. FIG. 3 is a sectional view showing a vertical sectional shape taken along a line III—III in FIG. 2. FIGS. 4 and 5 are sectional views showing ribs according to modifications of the first embodiment of the present invention.

In FIG. 1, a radiator 100 as a cooler main body is formed by caulking an upper tank 10 as an inlet portion and a lower tank 20 as an outlet portion on and under a core portion 30 so as to have an integral airtight and watertight structure. An upper hose connecting portion 11 as a connection tube is provided to the upper tank 10 so as to project therefrom. A lower hose connecting portion 21 as a connection tube is provided to the lower tank 20 so as to project therefrom. The upper and lower hose connecting portions 11, 21 are formed cylindrically, and one ends of hoses 40, 50 are connected to the upper and lower hose connecting portions 11, 21 respectively. The hoses 40, 50 are fitted on outer peripheral surfaces of the upper and lower hose connecting portions 11, 21. The other ends of the hoses 40, 50 are connected to an engine (not shown) or a thermostat (not shown) to form a circulation path of an engine cooling water.

Hot water which is passed through a cooling water path (water jacket) in the engine by a water pump (not shown) is supplied to the upper tank 10 via the hose 40. The hot water supplied to the upper tank 10 is cooled by wind caused by running of the vehicle or wind supplied by a radiator fan (not shown) when it is passed through the core portion 30 consisting of a number of fine water paths and radiation fins, then is supplied to the lower tank 20, and then is circulated to the thermostat (not shown) via the hose 50.

Substantially U-shaped ribs 15, 16 are provided on the outer sides of the upper and lower hose connecting portions 11, 21 so as to surround right, left and lower sides of the hose connecting portions 11, 21 respectively. The ribs 15, 16 are protruded integrally from the upper tank 10 and the lower tank 20. In the following descriptions, only ribs 15, 151 to 155 provided on the upper tank 10 will be explained in detail and thus duplicate descriptions of ribs provided on the lower tank 20 will be omitted.

If leakage water is generated from a fitting portion (connection portion) between the hose connecting portion 11 and the hose 40, as shown in FIG. 3, the rib 15 receives the leakage water once. If a very small amount of the leakage water is generated at that time, such leakage water can evaporate on the rib 15. Conversely, if a relatively large amount of the leakage water is generated, such leakage water flows along the rib 15 and then drops downward from an end portion 15*a* of the rib 15 into the engine room.

Accordingly, the water leaked from the fitting portion between the hose connecting portion 11 and the hose 40 never drops to a caulking portion 13 of the upper tank 10 and the core portion 30. Hence, the leakage water is in no way misconceived for the other leakage water generated from the caulking portion 13.

Respective dimensions W, D, H of the rib 15 shown in FIG. 2 can arbitrarily set in a range not to reduce an operation efficiency upon fitting the hose 40 to the hose connecting portion 11. In particular, the dimension D can be set to prevent such an event that the cooling water which drops downward into the engine room is attached to other portions so that misconception that it is the leakage water from the other portions is caused.

As shown in FIG. 4, an bottom portion of a rib 151 can be formed to have a falling gradient from its base portion 151*b* toward its top end portion 151*a*. According to such structure, the cooling water which leaks along a back surface of the bottom plate of the rib 151 cannot come up to the caulking portion 13. In addition, as shown in FIG. 5, a top end portion 152*a* of a rib 152 can be tilted or curved downward. In this case, the cooling water which leaks along a back surface of the bottom plate of the rib 152 never reaches the caulking portion 13.

According to the above ribs 15 shown in FIGS. 1 to 3, the rib 151 shown in FIG. 4, and the rib 152 shown in FIG. 5, an outer periphery of the hose connecting portion 11 is not surrounded throughout the whole periphery, but right, left, and lower sides of the hose connecting portion 11 are surrounded and an upper side is not surrounded. Thus, when the hose 40 is fitted to the hose connecting portion 11, it can be confirmed by visual observation whether or not the hose 40 has been completely inserted into a root portion of the hose connecting portion 11.

The ribs 15, 151, 152 have been provided to surround right, left, and lower sides of the hose connecting portion 11 in the description of the first embodiment, but the ribs may be provided only on the lower side of the hose connecting portion 11. At this time, a groove for guiding the leakage water to an appropriate position may be formed on a leakage water receiving surface of the rib 15, 151, or 152.

Second Embodiment

Figure 6:
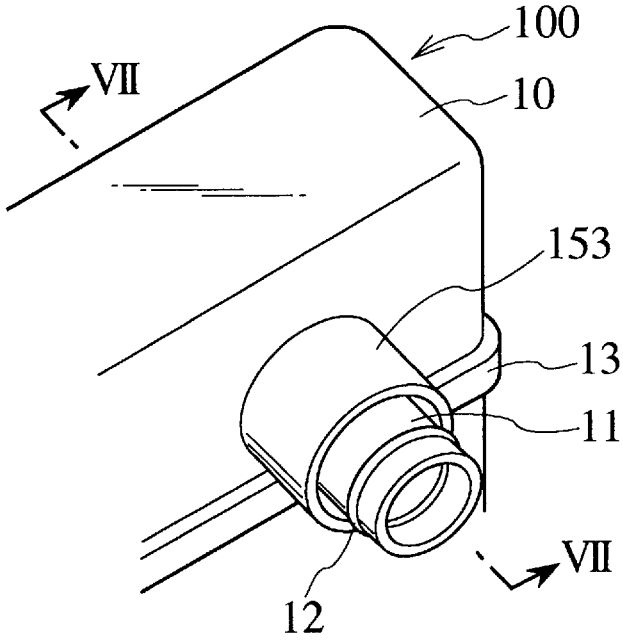
FIG. 6 is a perspective view showing a hose connecting portion of the upper tank of the radiator according to a second embodiment of the present invention.
Figure 7:
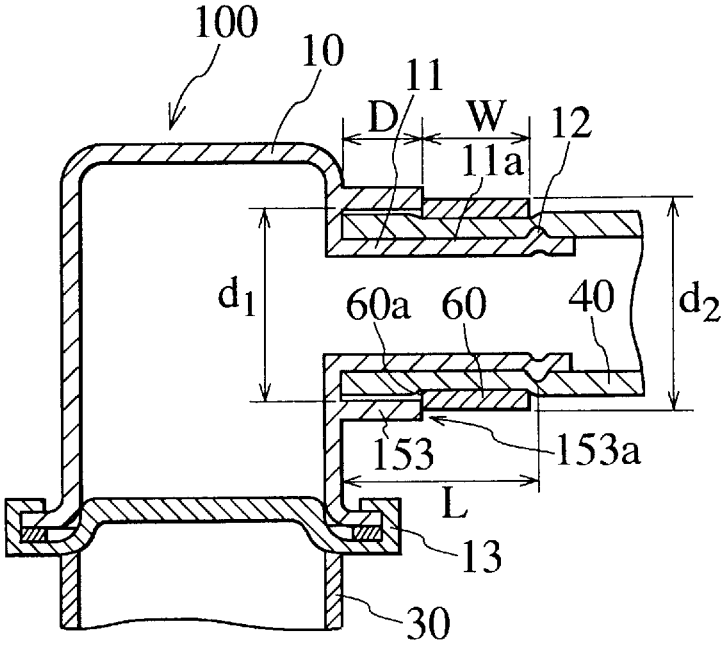
FIG. 7 is a sectional view showing a vertical sectional shape taken along a line VII—VII in FIG. 6 to illustrate a condition wherein a hose and a hose clamp are installed.

The rib 15, 151, or 152 according to the first embodiment of the present invention has been so formed that, even when the leakage water generated from the fitting portion between the hose connecting portion 11 and the hose 40 drops downward and then attaches to other portions, such leakage water can be guided to the position where the leakage water portion is not misconceived. A rib 153 according to the second embodiment of the present invention has a function of preventing generation of the leakage water because of clamping displacement together with the function of guiding the leakage water to the appropriate position. With reference to FIGS. 6 and 7, the second embodiment of the present invention will be explained hereunder. Incidentally, in FIGS. 6 and 7, like references in FIGS. 1 to 3 refer to like constituent elements or portions and therefore their descriptions will be omitted and mainly differences between the second embodiment and the first embodiment will be explained hereunder.

As shown in FIGS. 6 and 7, the rib 153 is formed to surround an outer periphery of the hose connecting portion 11. A clearance having a width in excess of the thickness of the hose 40 is formed between the rib 153 and the hose connecting portion 11. Assume that a length of the rib 153 is D, a width of the hose clamp 60 is W, an inner diameter of the rib 153 is d1, an outer diameter of the rib 153 is d2 when the hose clamp 60 is fitted on a predetermined position, and a dimension of the hose connecting portion 11 from the root portion on the upper tank 10 to the convex rim 12. Then, dimensional relationships are selected such that these dimensions can satisfy $d1<d2$ and $D+W<L$.

That is to say, since the outer diameter d2 is larger than the inner diameter d1 of the rib 153 when the hose clamp 60 is clamped on the predetermined position, the hose clamp 60 is not caused at all to enter into the inside of the rib 153. In addition, only by abutting an end surface 60*a* of the hose clamp 60 on the upper tank side to an end surface 153*a* of the rib 153 after the hose 40 is fitted on the hose connecting portion 11, the convex rim 12 can be positioned at the top end portion 11*a* of the hose connecting portion 11 so as to protrude towards the top end side rather than the hose clamp 60. The hose clamp 60 can be positioned on the predetermined position not to mounted on the convex rim 12 of the hose connecting portion 11.

In addition, the length D of the rib 153 is set to such a dimension that, once the leakage water is generated from the fitting portion between the hose connecting portion 11 and the hose 40, the water which drops from the end portion 153*a* of the rib 153 is not attached to the caulking portion 13 of the upper tank and the core portion 30.

With the above configuration, a fitting position of the hose clamp 60 can be stabilized and thus the leakage water due to defect in the fitting position of the hose clamp 60 can be prevented in advance. Once the fitting position of the hose clamp 60 is displaced, a clearance appears between the end surface 153*a* of the rib 153 and the end surface 60*a* of the hose clamp 60 on the upper tank side. As a consequence, displacement of the fitting position of the hose clamp 60 can be easily confirmed or detected. In addition, even if the leakage water is generated from the fitting portion between the hose connecting portion 11 and the hose 40, the water can drop downward from the end portion 153*a* of the rib 153. Therefore, such leakage water is never misconceived for the leakage water from the caulking portion 13 of the upper tank 10 and the core portion 30.

Third Embodiment

Figure 8:
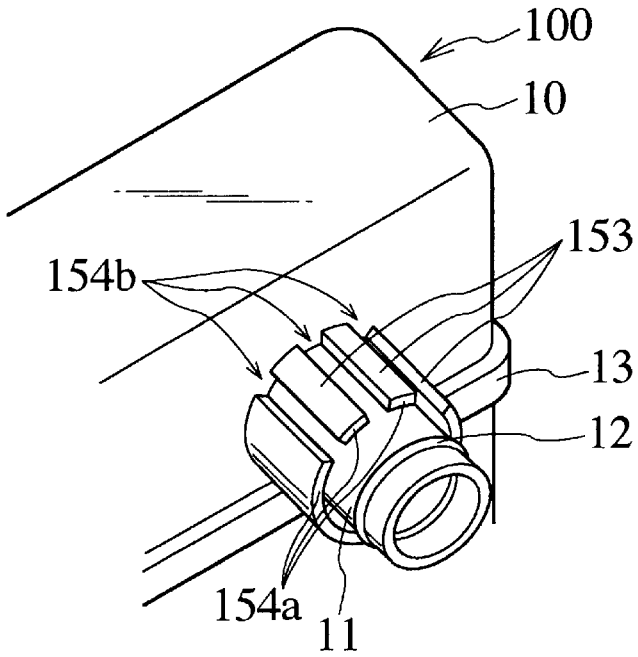
FIG. 8 is a perspective view showing a hose connecting portion of the upper tank of the radiator according to a third embodiment of the present invention.
Figure 9:
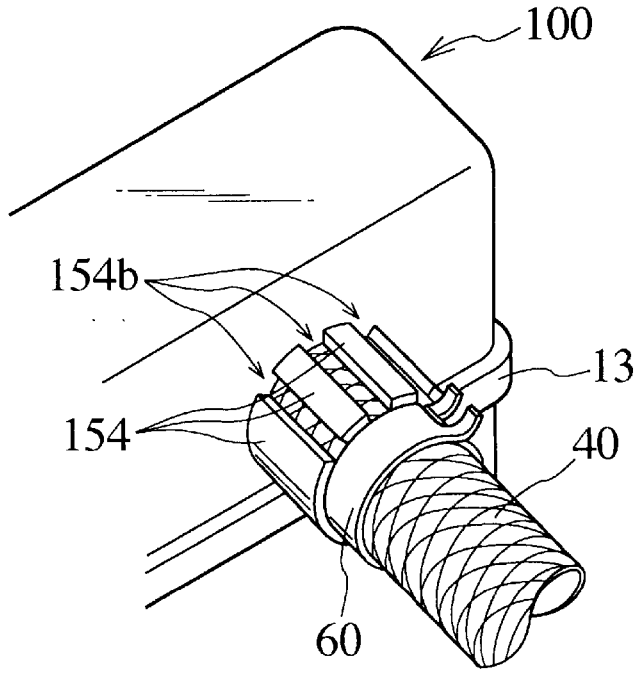
FIG. 9 is a perspective view showing a condition wherein a hose and a hose clamp are installed on the hose connecting portion of the upper tank in the radiator, shown in FIG. 8, according to the third embodiment of the present invention.

In the above second embodiment of the present invention, since the rib 153 has been provided around the whole periphery of the hose connecting portion 11, it is difficult to confirm by the visual observation whether or not the hose 40 has been inserted to the base portion of the hose connecting portion 11. The third embodiment can overcome this drawback. With reference to FIGS. 8 and 9, the third embodiment of the present invention will be explained hereunder. Incidentally, in FIGS. 8 and 9, like references in FIGS. 1 to 3 refer to like constituent elements or portions and therefore their descriptions will be omitted and mainly differences between the second embodiment and the first embodiment will be explained hereunder.

FIG. 8 is a view showing a pertinent portion of the upper tank according to a third embodiment of the present invention. FIG. 9 is a view showing a condition wherein the hose 40 and the hose clamp 60 are installed on the hose connecting portion 11 shown in FIG. 8.

A rib 154 shown in FIG. 8 corresponds to the rib 153 in FIG. 6, but notches 154*b* as opening portions are provided on the upper side of the rib 154 along the longitudinal direction of the rib 154. When the hose 40 is fitted on the hose connecting portion 11, it can be confirmed via the notches 154*b* whether or not the hose is inserted up to the base portion of the hose connecting portion 11, as shown in FIG. 9. The notches 154*b* are formed to the required minimum to confirm the fitted condition of the hose 40. Since the inner diameter and the length of the rib 154, the outer diameter and the width of the hose clamp 60, and the dimension from the side end portion of the hose connecting portion 11 on the upper tank 10 to the convex rim 12 are set similarly to those in the second embodiment, the hose clamp 60 can be clamped stably on the predetermined fitting position by fitting the hose clamp 60 on the hose 40 to abut to the end surface 154*a* of the rib 154. Once the leakage water is generated from the fitting portion between the hose 40 and the hose connecting portion 11, such leakage water cannot attach to the caulking portion 13 of the upper tank 10 and the core portion 30 by the action of the rib 154. Therefore, like the first and second embodiments, it becomes easy to specify the position of the leakage water.

Figure 10:
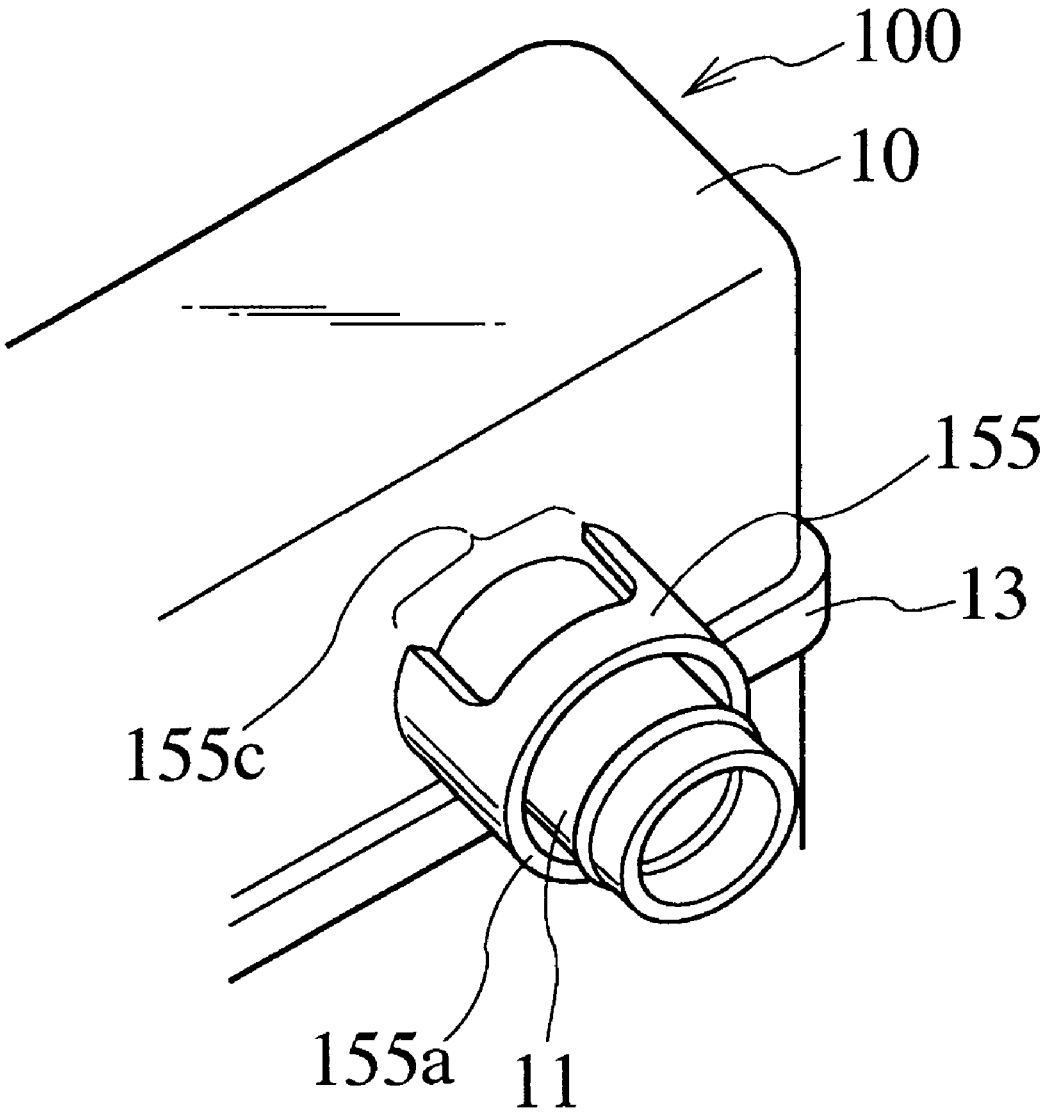
FIG. 10 is a perspective view showing a hose connecting portion of the upper tank in the radiator according to a modification of the third embodiment of the present invention.

The rib 154 provided on the radiator according to the above third embodiment has the opening portions over a plurality of locations along the longitudinal direction, but only one notch 154*b* may be provided. A shape of the notch can be selected as shown in FIG. 10. In other words, the end portion 1551 of the rib 155 is formed to be connected throughout the whole periphery, but the notch 155*c* is provided on the base side of the rib 154 in the circumferential direction. According to this structure, similar advantages can be achieved, and further much more opening portions can be provided on the rib 155 compared to the notches 154*b* shown in FIG. 9 without damaging the positioning performance of the hose clamp 60 and the visual observation characteristic upon fitting the hose 40 to the hose connecting portion 11 can be improved. Incidentally, since the upper tank 10 is often formed of resin, the ribs 15, 151 to 155 can be relatively freely formed, as described above.

In the above embodiments, the ribs 15, 16, 151 to 155 constitute the guiding member and the hose clamp 60 constitutes the clamping member.

The above structures of the present invention are not limited to those shown in the above embodiments.

What is claimed is:

1. A vehicle engine cooling radiator comprising:

two tanks;

a radiator main body arranged between said tanks, said radiator main body radiating an engine cooling water which flows from one of said tanks to the other of said tanks through said radiator main body;

a connection tube formed to protrude from at least one of said tanks, said connection tube connected with a hose which carries said engine cooling water; and a guiding member arranged below said connection tube and protruding from said one of said tanks to prevent a liquid leaked from a connection portion between said connection tube and said hose from contacting said one of said tanks.

2. A vehicle engine cooling radiator according to claim 1, wherein said guiding member is formed to surround at least a lower side and lateral sides of said connection tube.

3. A vehicle engine cooling radiator according to claim 2, wherein a clearance having a width larger than a thickness of said hose is formed between said guiding member and said connection tube, said hose is inserted into said clearance to be fitted on an outer surface of said connection tube, and said guiding member has an opening through which a top end of said hose connected to said connection tube is visually observed.

4. A vehicle engine cooling radiator according to claim 3, wherein said opening is formed on an upper side of said guiding member.

5. A vehicle engine cooling radiator according to claim 3, wherein said opening is formed as a notch.

6. A vehicle engine cooling radiator according to claim 1, wherein said hose is fitted on an outer surface of said connection tube and clamped on said connection tube by a clamping member mounted on said hose, said guiding member is formed to come into contact with said clamping member mounted on said hose so that said guiding member prevents said clamping member from entering into an inside of said guiding member, and said connection tube has a top end portion projected more than said clamping member mounted on said hose and being in contact with said guiding member.

7. A vehicle engine cooling radiator according to claim 6, wherein an inner diameter of said guiding member is formed to be smaller than an outer diameter of said clamping member.

8. A vehicle engine cooling radiator according to claim 6, wherein said connection tube has an annular convex rib to restrain a disconnection of said hose from said connection tube, and said convex rib is arranged on the top end portion of said connection tube.

9. A vehicle engine cooling radiator according to claim 1, wherein said guiding member carries the liquid away from said radiator main body.

* * * * *